US005348484A

United States Patent [19]

Sorrentino

[11] Patent Number: 5,348,484

[45] Date of Patent: Sep. 20, 1994

[54] GROUNDING SPRING CLIP FOR MODULAR JACKS

[75] Inventor: Gregory L. Sorrentino, Brewster, N.Y.

[73] Assignee: General DataComm, Inc., Middlebury, Conn.

[21] Appl. No.: 78,582

[22] Filed: Jun. 17, 1993

[51] Int. Cl.[5] ..... H01R 4/66

[52] U.S. Cl. ..... 439/101; 439/609; 439/676

[58] Field of Search ..... 439/101, 571, 676, 607, 439/609, 610, 939

[56] References Cited

U.S. PATENT DOCUMENTS

| | | | |
|---|---|---|---|
| 3,360,918 | 1/1968 | Johnson et al. | 439/939 X |
| 4,460,234 | 7/1984 | Bogese | 439/557 |
| 5,228,872 | 7/1993 | Liu | 439/676 X |

*Primary Examiner*—Eugene F. Desmond
*Attorney, Agent, or Firm*—David P. Gordon

[57] ABSTRACT

A grounding spring clip for modular jacks includes a stamped or etched plate having an opening substantially coextensive with the plug receiving opening in a modular jack and a bent tab to provide at least one springy finger extending out from the plate adjacent the opening and partially occluding the opening. Two opposite edges of the plate are bent backward to provide curls which wrap around corresponding edges of the face plate of a snap-in modular jack. One edge of the plate is bent to provide a tab stop and the edge opposite the tab stop is left straight. The grounding spring clip is slid onto the face plate of a snap-in modular jack before the jack is mounted in a chassis panel. When the jack is snapped into the chassis panel, the curled edges of the spring clip are biased between the face plate of the jack and the surface of the chassis panel thereby making a good electrical connection with the chassis. When a shielded modular plug is inserted into the jack, the springy finger adjacent the opening in the spring clip engages the outer sheath of the plug thereby making a good electrical connection with the shielding of the shielded cable carrying the plug. The integrity of the coupling is easily visually inspected and the spring clip can be quickly and inexpensively replaced if necessary.

20 Claims, 4 Drawing Sheets

GROUNDING SPRING CLIP FOR MODULAR JACKS

BACKGROUND OF THE INVENTION

1. Field of the Invention

This invention relates generally to modular jacks such as those commonly used in telecommunications and computer networking. More particularly, this invention relates to a spring clip 9 attachable to a snap-in panel modular jack where the spring clip provides the jack with a grounded shield for electromagnetic interference (EMI) isolation and suppression when used with a shielded modular plug.

2. State of the Art

Modular plugs and jacks are widely used in telecommunications. In recent years they have also been used extensively in computer networking. These plugs and jacks are durable, reliable, and are inexpensive to manufacture with copper conductors held inside a molded plastic body. The jacks usually include a rectangular opening with at least one upper keyway. A plurality of springy copper "finger" contacts extend upward and rearward from the bottom side of the jack into the rectangular opening. A plug having a rectangular cross section, lower surface contacts bounded in channels and an upper springy key lock is insertable into the jack. The upper springy key lock on the plug engages the upper keyway in the jack while the lower surface contacts on the plug are engaged by the springy finger contacts in the jack which are maintained in proper alignment by the channels in the plug. When the plug is fully inserted into the jack, the upper springy key lock snaps into a locking position with the upper keyway of the jack. The upper springy lock of the plug extends outside the jack so that it can be pressed down against the plug to disengage the key lock from the keyway to permit the plug to be removed from the jack.

Prior art FIGS. 1*a*–1*d* show side elevation views of the open plug receiving end of four slightly different modular jacks such as those supplied by AW Industries, Inc., 6788 NW 17th Avenue, Ft. Lauderdale, Fla. 33309. Each of the jacks has a face plate 5 with a generally rectangular opening 10, an upper keyway 12 and a plurality of finger contacts 14. The number of finger contacts, the size of the rectangular opening and the number of keyways may vary according to different applications, but all of these jacks have the same general configuration as described above. Beyond the face plate 5, these jacks assume a substantially cubic or box-like shape and are provided with electrical edge card contacts 16 (FIG. 2*a*) at a rear portion for coupling the contacts with the gold plated fingers of a printed circuit board.

Prior art FIGS. 2*a*–2*c* show rear, top and side views of a prior art modular jack such as the AWI 7600 series designed for snap-in fitting to a rectangular hole in a chassis panel. This jack has a generally cubic shaped body 7 with a pair of forward and outward extending springy ears 18*a*, 18*b*. The jack is snap fit to a chassis panel 19 by inserting the rear end of the jack into a rectangular hole in the chassis panel. The ears 18*a*, 18*b* are biased inward towards the body 7 by the sides of the hole in the chassis panel 19 until they pass through the hole and spring back to their original position. The body 7 of the jack is dimensioned to fit through the hole and the face plate 5 is dimensioned to remain outside the hole. When the jack is snapped into the hole, the wall of the chassis panel resides between the face plate 5 and the ears 18*a*, 18*b*.

Prior art FIGS. 2*d* and 2*e* show perspective views of a plug 60 for use with a jack such as the one shown in FIG. 1*d*. As mentioned above, the plug 60 is provided with an upper springy keylock 64 and lower edge contacts 65.

As mentioned above, modular plugs and jacks such as those described have been used in telecommunications for many years. In most telecommunications applications, the electrical cables coupled by modular plugs and jacks are "unshielded". In recent years, however, these types of plugs and jacks have been used in computer networking to couple nodes for high speed data communication. The cables used in these applications often must be shielded from electromagnetic interference (EMI). Clearly, it would be advantageous to adapt the known modular plugs and snap-in jacks to provide a shielded coupling. To address this problem, the art has provided a shielding of the modular plug by wrapping a portion of the outer surface of the modular plug with a conductive sheath or collar, e.g. 66 in FIGS. 2*d* and 2*e*. The outer conductive sheath is arranged to contact the shielding foil or braid of the cable 62 carrying the plug. However, the art has not been as successful in providing a shielded jack. Presently, shielding of the jack is accomplished by soldering the jack to a PC board and keeping the jack within the chassis (unlike the snap-in panel jacks described above). The interior of the jack has been modified to provide an electrical coupling with the outer sheath of the shielded plug and this coupling has been ground traced to the chassis. This arrangement, however, has drawbacks. First, the plug shield coupling inside the jack is subject to untimely wear and the integrity of the coupling cannot be visually inspected. When the coupling fails, the entire jack must be replaced by desoldering and resoldering a new jack, which is time consuming. Alternatively, the entire PC board must be replaced, which is expensive. Second, because the jack is soldered to the PC board, the PC board must be supplied by the manufacturer with extra jacks which may go unused in order to provide for expansion. Alternatively, if the PC board is provided with a set number of jacks, if a user requires additional jacks, the additional jacks must either be soldered onto the board, or the board must be replaced with another PC board having additional jacks.

SUMMARY OF THE INVENTION

It is therefore an object of the invention to provide a simple inexpensive means for shielding a modular jack.

It is also an object of the invention to provide a means for shielding a modular jack which does not require soldering the jack to a PC board.

It is another object of the invention to provide a means for shielding known snap-in panel jacks.

It is still another object of the invention to provide a snap-in panel jack shielding device which is retro-fittable to existing snap-in panel jacks.

It is also an object of the invention to provide a snap-in panel jack shielding device which has a direct, localized ground connection to the chassis panel.

It is another object of the invention to provide a snap-in panel jack shielding device which has a positive connection to a shielded plug on a portion of the plug outside the jack.

It is still another object of the invention to provide a shielding device for a snap-in panel jack which has multiple springy contacts for assuring a positive low impedance connection between the outer sheath of a shielded plug and the chassis panel.

It is a further object of the invention to provide a shielding device for a snap-in panel modular jack which clips on to the jack and does not require fasteners or adhesives.

It is still a further object of the invention to provide a shielding device for a snap-in panel modular jack which is easily removable and replaceable.

In accord with these objects which will be discussed in detail below, the grounding spring clip for modular jacks of the present invention broadly comprises a stamped or etched conductive plate with jack engaging means, plug engaging means, and ground connecting means. More particularly, a stamped or etched conductive plate is provided with a central opening which may be substantially coextensive with the plug receiving opening of the modular jack. The plate is bent at the central opening to provide at least one springy finger (i.e., plug engaging means) extending out from the plate adjacent the opening and partially occluding the opening. Two opposite edges of the plate are bent to provide curls (i.e., jack engaging means) which wrap around corresponding edges of the face plate of a snap-in modular jack. One edge of the plate is bent to provide a tab stop and the edge opposite the tab stop is left straight. The grounding spring clip is slid onto the face plate of a snap-in modular jack before the jack is mounted in a chassis panel. An edge of the face plate is aligned with the free edge of the spring clip and the spring clip is slid over the face plate so that the two opposite curled edges embrace opposite edges of the face plate. The tab stop on the edge of the spring clip opposite the free edge stops the spring clip from sliding off the face plate and locates the opening in the spring clip over the plug receiving opening in the face plate of the jack. When the jack is snap fit to the chassis panel, the curled edges of the spring clip are biased between the face plate of the jack and the surface of the conductive chassis panel thereby making a good electrical connection with the chassis and mechanically fixing the spring clip in position. When a shielded modular plug is inserted into the jack, the springy finger adjacent the opening in the spring clip engages the outer sheath of the plug thereby making a good electrical connection with the shielding of the shielded cable carrying the plug. The spring clip is preferably formed of beryllium copper, and the high conductivity of the beryllium copper assures a low impedance coupling of the shielding of the shielded plug to the grounded chassis panel. The coupling can be visually inspected and the spring clip can be quickly and easily replaced if necessary.

Preferred aspects of the grounding spring clip for modular jacks include: forming the springy fingers as two pair of opposed curved strips on opposite sides of the plug receiving opening thereby adding redundancy to the plug-clip coupling; and bifurcating each of the curled edges to add redundancy to the clip-chassis panel coupling.

Additional objects and advantages of the invention will become apparent to those skilled in the art upon reference to the detailed description taken in conjunction with the provided figures.

DETAILED DESCRIPTION OF THE PREFERRED EMBODIMENTS

Figure 1A:
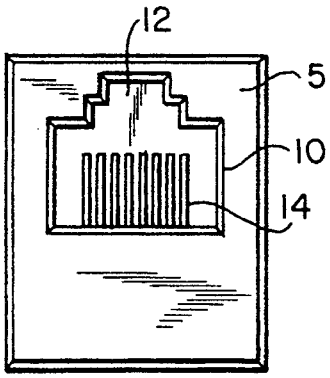
FIG. 1a PRIOR ART
FIGS. 1*a*–1*d* are side elevation views of prior art plug receiving face plates of known snap-in panel modular jacks.
Figure 1B:
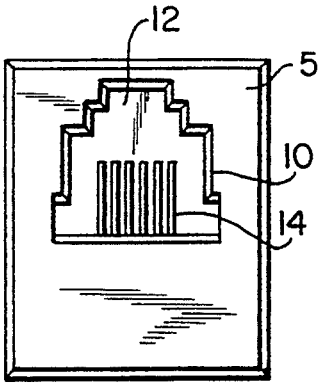
FIG. 1b PRIOR ART
Figure 1C:
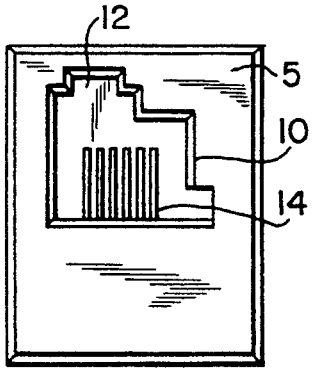
FIG. 1c PRIOR ART
Figure 1D:
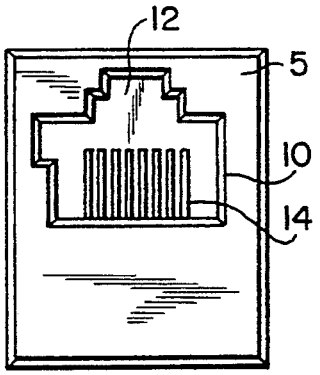
FIG. 1d PRIOR ART
Figure 2A:
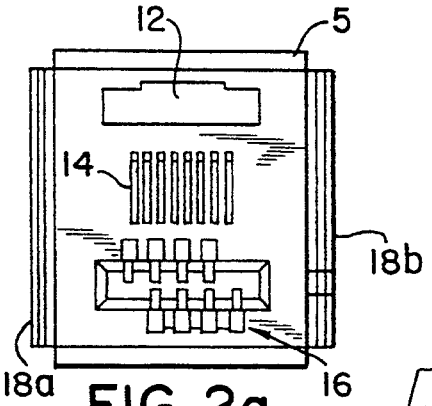
FIG. 2a PRIOR ART
FIG. 2*a* is a side elevation view of the rear end of a prior art snap-in panel modular jack.
Figure 2C:
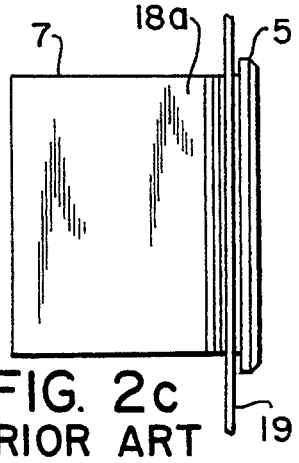
FIG. 2c PRIOR ART
FIG. 2*c* is a side elevation view of a side of a prior art snap-in panel modular jack.
Figure 2B:
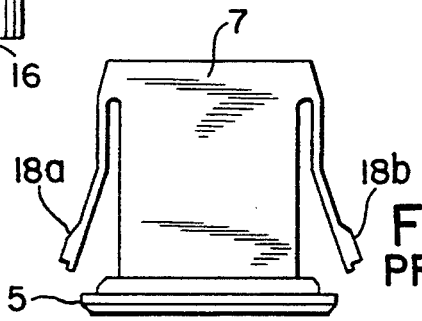
FIG. 2b PRIOR ART
FIG. 2*b* is a top view of a prior art snap-in panel modular jack.
Figure 2D:
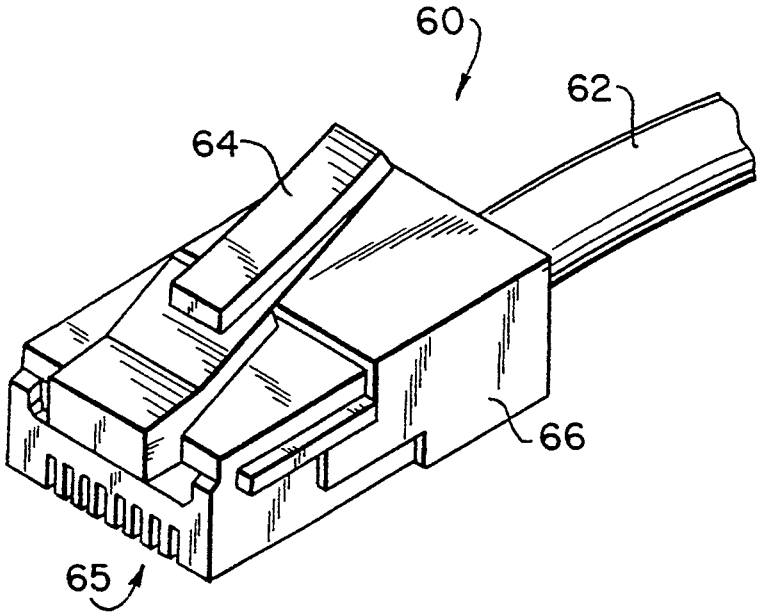
FIG. 2d PRIOR ART
FIGS. 2*d* and 2*e* are perspective top and bottom views of a prior art modular plug.
Figure 2E:
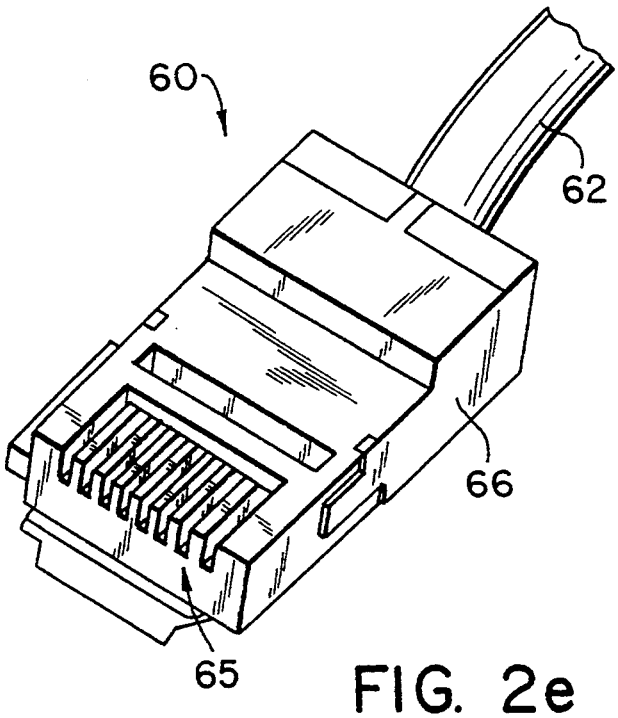
FIG. 2e PRIOR ART
Figure 3A:
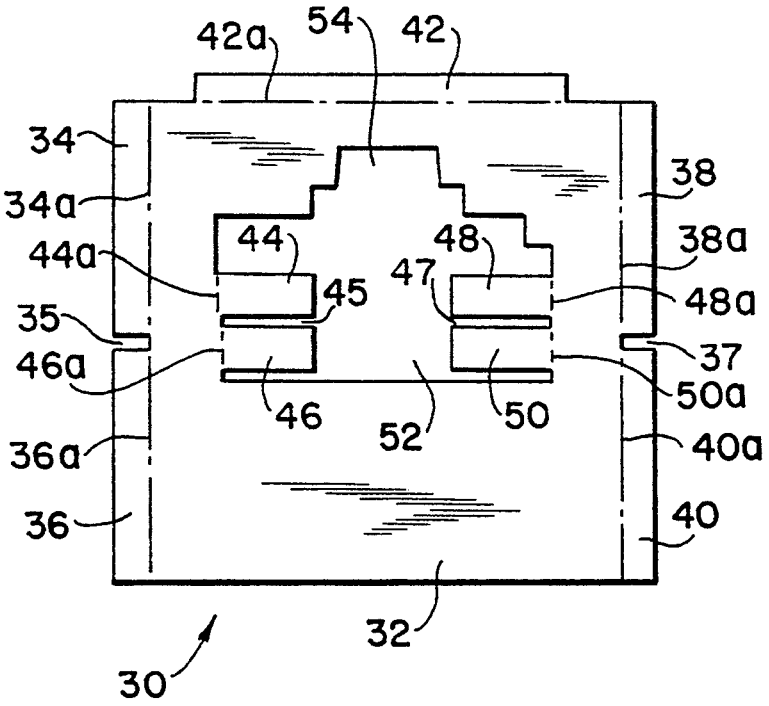
FIG. 3*a* is a plan view of a sheet of conductive material stamped or etched but not yet bent to form the grounding spring clip of the invention having a plug receiving opening conforming to the prior art jack shown in FIG. *d;*
Figure 3B:
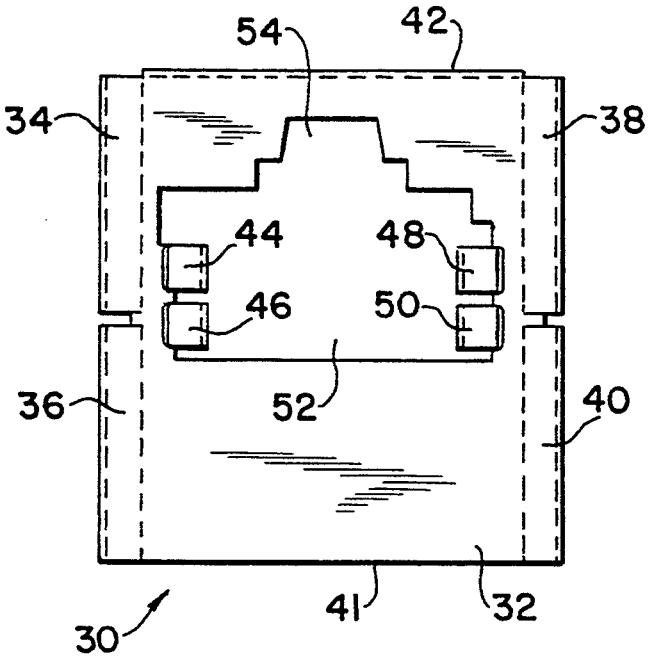
FIG. 3*b* is a side elevation view of the sheet of conductive material of FIG. 3*a* after bending to form the grounding spring clip according to the invention.
Figure 3C:
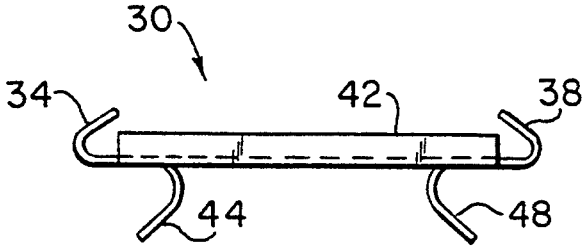
FIG. 3*c* is a top view of the grounding spring clip of FIG. 3*b*.

Referring now to FIGS. 3*a*–3*c* and 4, the grounding spring clip 30 generally comprises a rectangular sheet of thin conductive material 32, preferably 0.007 inch thick, ¼ hard (material temper before heat treatment) beryllium copper which is stamped or etched and then bent prior to heat treatment to R15N 76 minimum provide the clip with desirable spring properties. The sheet 32 is dimensioned slightly larger than the face plate 5 of a snap-in modular jack (FIGS. 1*a*–1*d*, 2*a*–2*c*, and 4) and is stamped or chemically etched to form a central opening 52 and a plurality of bendable tabs 34–50. Central opening 52 is ideally configured and located to substantially duplicate the plug receiving opening 10 in the face plate 5 of a standard snap-in modular jack (e.g. FIG. 1*d*) including an upper keyway 54 corresponding to the jack keyway 12. Inner tabs 44–50 partially occlude the central opening 52 and are bent forward from the central opening at respective bending lines 44*a*–50*a* with a convex curvature facing the opening 52 as seen best in FIG. 3*c*. Outer edge tabs 34–42 are bent backward in essentially two different ways. Tabs 34, 36, 38, and 40 are bent backward approximately 135 degrees at respective bend lines 34*a*–40*a* to form opposed curled edges as seen best in FIGS. 3*c* and 4. Tab 42 is bent down approximately 90 degrees to form a top tab stop, also seen best in FIGS. 3*c* and 4.

Figure 4:
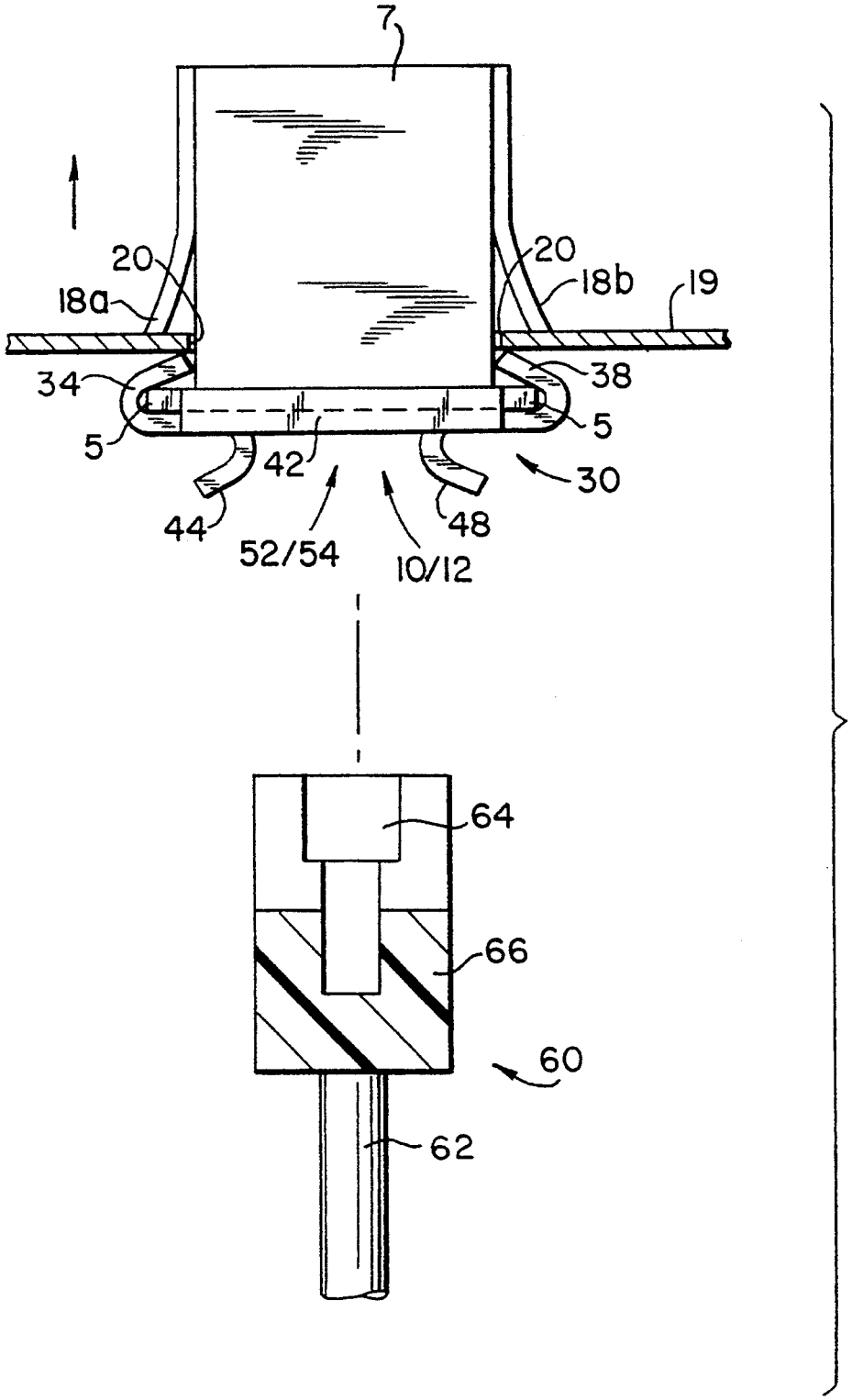
FIG. 4 is a top view of the spring clip of FIGS. 3*b* and 3*c* attached to a prior art snap-in modular jack, such as the jack shown in FIG. 2*b*, mounted to a chassis panel, and a shielded modular plug ready for insertion into the jack.

The completed grounding spring clip 30 thus has two rearward curled edges 34,36 and 38, 40, a top tab stop edge 42, and a bottom flat edge 41. The central opening 52 is partially occluded by opposite pairs of springy fingers 44, 46 and 48, 50. The spring clip 30 is attached to the face plate 5 of a snap-in modular jack 7, as shown in FIG. 4, by aligning the flat edge 41 of the spring clip with the face plate 5 and sliding so that the curled edges 34, 36 and 38, 40 embrace the side edges of the face plate 5 and the top tab stop 42 rests against the top of the face plate 5. After the spring clip 30 is attached to the face plate 5 of the snap-in jack 7, the jack is inserted into a rectangular opening 20 in a grounded conductive chassis panel 19 by pushing the jack in the direction of the arrow in FIG. 4. As described above, when the springy ears 18*a*, 18*b* of the jack pass through the opening 20, the ears spring outwardly to bias the face plate 5 against the front side of the panel 19. As best seen in FIG. 4, the curled edges 34, 36, 38, 40 of the spring clip 30 are trapped between the face plate 5 and the panel 19 where they are well biased against the panel 19, thereby making a good electrical connection with the panel and mechanically securing the spring clip in position with respect to the jack.

FIG. 4 also shows a shielded modular plug 60 carried on a shielded cable 62. The plug 60 has a substantially rectangular cross section which substantially corresponds to the rectangular opening 10 in the jack 7 and the central opening 52 in the spring clip 30. The plug 60 has a key lock 64 which engages the keyway 12 in the jack 7 (and the keyway 54 in the spring clip 30). A conductive sheath 66 is provided on the plug for coupling with a grounding connection at the jack 7. As mentioned above, the grounding connection to the sheath 66 is provided by the spring clip of the invention. When the plug is inserted into the jack, the springy fingers 44–50 which partially occlude the plug receiving opening in the jack are pressed outward by the plug and biasingly engage the sides of the sheath 66. The convex curvature of the springy fingers enables the plug to spread the fingers apart to enter the jack. Those skilled in the art will appreciate, however, that other angled bends in the springy fingers could accomplish the same result without curving.

Those skilled in the art will appreciate that the electrical coupling made by the spring clip 30 of the invention between the shielded plug sheath 66 and the grounded panel 19 is easy to inspect visually for integrity. Moreover, as described above, the spring clip is easy and inexpensive to manufacture and easy to install and/or replace. The above-described preferred embodiment is provided with several redundancies to assure trouble free operation. Nevertheless, it will be appreciated, for example, that the curled edges 34–40 may be formed from two tabs instead of four by omitting the cuts at 35, 37 shown in FIG. 3*a*. Similarly, the inward extending springy fingers 44–50 may be formed from two tabs instead of four by omitting the cuts at 45, 47 shown in FIG. 3*a*. In fact, only one springy finger and one tab are absolutely required.

There have been described and illustrated herein several embodiments of a grounding spring clip for use with a snap-in modular jack. While particular embodiments of the invention have been described, it is not intended that the invention be limited thereto, as it is intended that the invention be as broad in scope as the art will allow and that the specification be read likewise. Thus, while particular configurations of a central opening have been disclosed, it will be appreciated that other configurations could be utilized. In particular, the central opening need not mimic the opening in the face plate of the jack so long as the springy fingers partially occlude the jack opening so that they contact the plug sheath. Also, while the springy fingers have been shown as curving away from the central opening of the spring clip, it will be recognized that other arrangements could be used with similar results obtained. For example, the springy fingers might be angled into the opening from sides or bottom or might be formed as a separate piece which is welded to the spring clip. Moreover, while particular materials and dimensions have been disclosed, it will be appreciated that other materials and dimensions could be used so long as the spring clip engages both the grounded panel and the shielded plug sheath. In addition, while the invention has been disclosed for use with a snap-in panel modular jack, those skilled in the art will realize that the springy fingers of the clip can be used on a clip which fits over other types of modular jacks so long as the clip is traced to ground and many of the advantages of the invention can thus be obtained for other types of jacks. It will therefore be appreciated by those skilled in the art that yet other modifications could be made to the provided invention without deviating from its spirit and scope as so claimed.

I claim:

1. A grounding coupling for use with a modular jack to couple the conductive sheath of a shielded modular plug with an electrical ground, the modular jack having a plug receiving opening, said coupling comprising:

a) a jack engaging means embracing at least a portion of an outer surface of the modular jack;

b) a conductive plug engaging means coupled to said jack engaging means and extending from said jack engaging means in a direction which does not enter the plug receiving opening when said coupling is attached to the jack and such that when the shielded plug is inserted into the jack, the plug engaging means makes a biased contact with the conductive sheath of the plug; and c) ground connecting means electrically coupled to said jack engaging means and electrically coupled to electrical ground.

2. A grounding coupling according to claim 1 where the jack is a snap-in panel mounted jack having a face plate with a lip, wherein:

said jack engaging means comprises an electrically conductive plate with an opposed pair of bent edges, said bent edges embracing the lip of the face plate.

3. A grounding coupling according to claim 2 where the shielded modular plug is coupled to a grounded chassis panel, wherein:

said ground connecting means comprises an end of at least one of said bent edges which resides between the face plate lip and the grounded chassis panel when the snap-in panel mounted jack is snapped-in the grounded chassis panel.

4. A grounding coupling according to claim 2, wherein:

said bent edges are bent approximately 135 degrees backward from said conductive plate.

5. A grounding coupling according to claim 2, wherein:

said electrically conductive plate has a central opening large enough to allow passage of the modular plug, and said plug engaging means comprises a bent tab extending from said conductive plate and partially occluding said central opening.

6. A grounding coupling according to claim 2, wherein:

said electrically conductive plate has a third bent edge perpendicular to and located between said opposed pair of bent edges and a fourth straight edge parallel to and opposite said third bent edge so that said jack engaging means is slidable on to and off of the face plate.

7. A grounding coupling according to claim 3, wherein:

said opposed pair of bent edges are each bifurcated.

8. A grounding coupling according to claim 1, wherein:

said plug engaging means comprises a bent tab.

9. A grounding coupling according to claim 8, wherein:

said plug engaging means comprises a pair of bent tabs.

10. A grounding coupling according to claim 5, wherein:

said plug engaging means comprises a pair of bent tabs extending from said conductive plate on opposite sides of said central opening.

11. A grounding coupling according to claim 10, wherein:

said pair of bent tabs make biased contact at opposite sides of the conductive sheath of the plug.

12. A grounding coupling according to claim 10, wherein:

each of said bent tabs are bifurcated.

13. A grounding coupling according to claim 10, wherein:

each of said bent tabs is curved convexly towards said central opening.

14. A grounding coupling according to claim 5, wherein:

said bent tab is curved convexly towards said central opening.

15. A grounding coupling according to claim 2, wherein:

said conductive plate is beryllium copper.

16. A grounding coupling according to claim 1, wherein:

said jack engaging means, said conductive plug engaging means, and said ground connecting means are all formed from a single conductive plate which has a central opening large enough to allow passage of the modular plug.

17. A grounding coupling for use with a snap-in modular jack having a face plate with a lip and a plug receiving opening to couple the conductive sheath of a shielded modular plug with a grounded chassis panel, said coupling comprising:

an electrically conductive plate having a central opening large enough to allow passage of the modular plug, said electrically conductive plate formed with a jack engaging means with an opposed pair of bent edges embracing at least a portion of the lip of the face plate of the modular jack, an end of at least one of said bent edges comprising a ground connecting means electrically coupled to said jack engaging means and electrically coupled to electrical ground, and a conductive plug engaging means partially occluding said central opening and extending in a direction such that when the shielded plug is inserted into the jack, the plug engaging means makes a biased contact with the conductive sheath of the plug, wherein said conductive plug engaging means extends in a direction which does not enter the plug receiving opening when said coupling is attached to the jack so that the coupling is slideable on to the face plate by sliding said pair of bent edges over the lip of the face plate.

18. A grounding coupling according to claim 17, wherein:

said electrically conductive plate has a third bent edge perpendicular to and located between said opposed pair of bent edges and a fourth straight edge parallel to and opposite said third bent edge so that said jack engaging means is slidable on to and off of the face plate.

19. A grounding coupling according to claim 17, wherein:

said plug engaging means comprises a pair of bent tabs extending from said conductive plate on opposite sides of said central opening for making biased contact at opposite of the conductive sheath of the plug.

20. A grounding coupling according to claim 19, wherein:

each of said bent tabs is curved convexly towards said central opening.

* * * * *